US006116963A

United States Patent [19]

Shutter

[11] Patent Number: 6,116,963

[45] Date of Patent: Sep. 12, 2000

[54] TWO-PIECE MICROELECTRONIC CONNECTOR AND METHOD

[75] Inventor: Ronald A. Shutter, Encinitas, Calif.

[73] Assignee: Pulse Engineering, Inc., San Diego, Calif.

[21] Appl. No.: 09/169,842

[22] Filed: Oct. 9, 1998

[51] Int. Cl.[7] ..... H01R 24/00

[52] U.S. Cl. ..... 439/676; 439/344

[58] Field of Search ..... 439/676, 941, 439/620, 344, 701

[56] References Cited

U.S. PATENT DOCUMENTS

| | | | |
|---|---|---|---|
| 4,695,115 | 9/1987 | Talend . | |
| 4,699,595 | 10/1987 | Nakazawa et al. | 439/676 |
| 4,726,638 | 2/1988 | Farrar et al. . | |
| 4,772,224 | 9/1988 | Talend . | |
| 4,995,834 | 2/1991 | Hasegawa . | |
| 5,015,204 | 5/1991 | Sakamoto et al. . | |
| 5,015,981 | 5/1991 | Lint et al. . | |
| 5,069,641 | 12/1991 | Sakamoto et al. . | |
| 5,139,442 | 8/1992 | Sakamoto et al. . | |
| 5,178,563 | 1/1993 | Reed . | |
| 5,282,759 | 2/1994 | Sakamoto et al. . | |
| 5,397,250 | 3/1995 | Briones . | |
| 5,399,107 | 3/1995 | Gentry et al. . | |
| 5,403,207 | 4/1995 | Briones . | |
| 5,456,619 | 10/1995 | Belopolsky et al. . | |
| 5,475,921 | 12/1995 | Johnston . | |
| 5,587,884 | 12/1996 | Raman . | |
| 5,647,767 | 7/1997 | Scheer et al. . | |
| 5,687,233 | 11/1997 | Loudermilk et al. . | |
| 5,697,817 | 12/1997 | Bouchan et al. | 439/676 |
| 5,736,910 | 4/1998 | Townsend et al. . | |
| 5,766,043 | 6/1998 | Talend . | |
| 5,872,492 | 2/1999 | Boutros . | |
| 5,876,239 | 3/1999 | Morin et al. . | |

FOREIGN PATENT DOCUMENTS

| | | |
|---|---|---|
| 654865 A1 | 5/1995 | European Pat. Off. . |
| WO94/05059 | 3/1994 | WIPO . |

*Primary Examiner*—Gary F. Paumen
*Assistant Examiner*—Ross Gushi
*Attorney, Agent, or Firm*—Knobbe, Martens, Olson & Bear, LLP

[57] ABSTRACT

A multi-piece, low profile microelectronic connector having a simplified, "snap-together" construction requiring no lead carrier. One or more electrical components are located within a rear connector body element, which mates with a front connector body element upon assembly. The leads of the rear body element are shaped so as to cooperate with a series of contour elements ("bumps" in one embodiment) formed inside the plug receptacle cavity in the front connector body element. The shape of the leads and bumps provide a continuous normal force on the distal end of the leads, thereby maintaining them in contact with the corresponding leads of the modular plug. In a second aspect of the invention, a series of mounting pins are provided to permit tandem mounting of multiple connectors to an external device using a minimum number of mounting holes, and maintaining a minimum lateral connector width. A method of manufacturing and assembling the aforementioned connector is also disclosed.

37 Claims, 19 Drawing Sheets

| FIG.17a |
| --- |
| FIG.17b |

TWO-PIECE MICROELECTRONIC CONNECTOR AND METHOD

BACKGROUND OF THE INVENTION

1. Field of the Invention

The invention relates generally to miniature electrical connectors used in printed circuit board and other microelectronic applications, and particularly to an improved microelectronic connector and method of fabricating the same.

2. Description of Related Technology

Existing microelectronic electrical connectors (such as those of the RJ 45 or RJ 11 type) frequently incorporate magnetics or other electrical components to provide a variety of functions, such as signal voltage transformation or noise suppression. In one common connector design, the magnetics or component package is fabricated as a separate device that is then subsequently inserted within or mated to another component of the connector. See, for example, U.S. Pat. No. 5,647,767 "Electrical Connector Jack Assembly for Signal Transmission" ("'767 patent"), and U.S. Pat. No. 5,587,884, "Electrical Connector Jack with Encapsulated Signal Conditioning Components" ("'884 patent"). A related design illustrated in U.S. Pat. No. 5,178,563, "Contact Assembly and Method for Making Same" employs the multi-component arrangement of the '767 and '884 patents, yet with no installed electrical component. Common to each of the aforementioned designs is the use of a separate lead insulator or "carrier" that insulates and segregates the electrical leads connecting the modular plug contacts with the electrical component (or output leads of the connector). This general lead carrier arrangement is illustrated in FIG. 1*a*.

In addition to the functions listed above, the lead carrier also acts as a mechanical fulcrum for the leads when installed as shown in FIG. 1*b*. Specifically, the distal ends of the leads engage the contacts of the modular plug when the plug is inserted into the connector body, thereby tending to bend the leads upward and away from the plug. The carrier tends to maintain the leads engaged with their respective contacts on the modular plug, thereby increasing the reliability of the connector. This is especially true during relative movement of the plug within the connector body or after many insertion/removal duty cycles.

While providing the above-identified functionality, the use of a lead carrier has several drawbacks as well. Specifically, the additional labor and materials associated with molding and inspecting the lead carrier adds significant additional cost to the final product. Furthermore, the connector body ("sleeve") requires additional costly tooling to accommodate the carrier. After carrier insertion, the distal ends of the leads may also be bent into their final position. This adds another process step and precludes the subsequent removal of the leads and carrier from the connector body. Additionally, the carrier provides no bias or resistance to separating the component package (and carrier) from the connector body, thereby necessitating the use of adhesives or other means for maintaining these components tightly joined.

Another important consideration in microelectronic connector design is space. Ideally, a connector will consume the smallest possible amount of space within the interior of the host device in which it is installed. Furthermore, there ideally should be no penalty for mounting connectors in tandem (e.g., side-by-side), such that the space required for two or three connectors in tandem is exactly two or three times the space required, respectively, for a single connector.

Prior art tandem connector mounting systems have typically required additional space to accommodate mounting hardware, such mounting hardware further necessitating the creation of numerous mounting holes or perforations in the device to which the connectors are being mounted. One approach for resolving this problem (as illustrated in FIGS. 1 and 2 of the aforementioned U.S. Pat. No. 5,178,563) has been to utilize a common connector body housing for two or more tandem connectors and two mounting pins; however, this configuration suffers the drawback of having to replace the entire assembly upon the failure of a single connector (as opposed to merely replacing the defective single connector).

Accordingly, it would be most desirable to provide an improved microelectronic connector design that would yield a simpler and more reliable connector, and further facilitate more economical fabrication. Such a connector design would avoid the use of a separate lead carrier and mating adhesives, thereby simplifying the manufacturing process and reducing device cost. The improved connector would also have minimum external dimensions, and would utilize a simplified and compact mounting system to further reduce manufacturing costs and save space on the interior of the host device.

SUMMARY OF THE INVENTION

The present invention satisfies the aforementioned needs by providing an improved microelectronic connector and method of fabricating the same.

In a first aspect of the invention, an improved multi-piece microelectronic connector is disclosed which incorporates a simplified design and permits rapid assembly of the connector components during manufacture. In one embodiment, the connector is comprised of two main body elements. The first body element ("sleeve") has a cavity that acts effectively as a receptacle for both the modular plug and the electrical leads of the second body element ("trailer"). A series of contour elements (specially shaped "bumps" in the present embodiment) are disposed within the cavity, and cooperate with specially shaped bends in the aforementioned leads to (i) align the leads within the cavity, (ii) maintain the distal ends of the leads in contact with corresponding leads on the modular plug, and (iii) assist in maintaining the two body elements joined. In this embodiment, the second body element contains one or more electrical components such as a choke coil or transformer, and additional leads for connecting the second body element (and connector) to an external device such as a circuit board. Using this "bump and bend" arrangement, the need for a separate lead carrier is obviated, thereby simplifying manufacturing/assembly and reducing connector cost.

In a second aspect of the invention, an improved microelectronic connector having a reduced profile and modular construction is disclosed. In one embodiment, the aforementioned two-piece connector body is utilized in conjunction with a series of truncated split end "snap" pins. The pins are molded at and flush with the side edges of the first connector body element such that no additional lateral space is needed to accommodate adjacent pins on adjacent connector bodies. A single, specially shaped perforation in the mounting substrate (circuit board in the present embodiment) is used to receive and secure the adjacent pins of two adjacent connectors. In this fashion, two adjacent connectors can be retained within the substrate using only one perforation, and with an absolute minimum lateral dimension. In a third aspect of the invention, an improved method is disclosed for fabricating the improved microelectronic connector described above. In one embodiment, the first connector body element is formed, and the interlock base (and associated leadframe) prepared for inclusion within the second connector body element. The second connector body element containing the interlock base and leadframe is then formed. The plug-side electrical leads of the second body element are then shaped as previously described without using a separate lead carrier as in the prior art. Finally, the first and second body elements are mated together, the plug-side electrical leads of the second body element being inserted into the cavity of the first body element, and the two body elements in effect "snapping" together. The finished product is then tested and inspected.

DETAILED DESCRIPTION OF THE INVENTION

Reference is now made to the drawings wherein like numerals refer to like parts throughout.

Figure 1A:
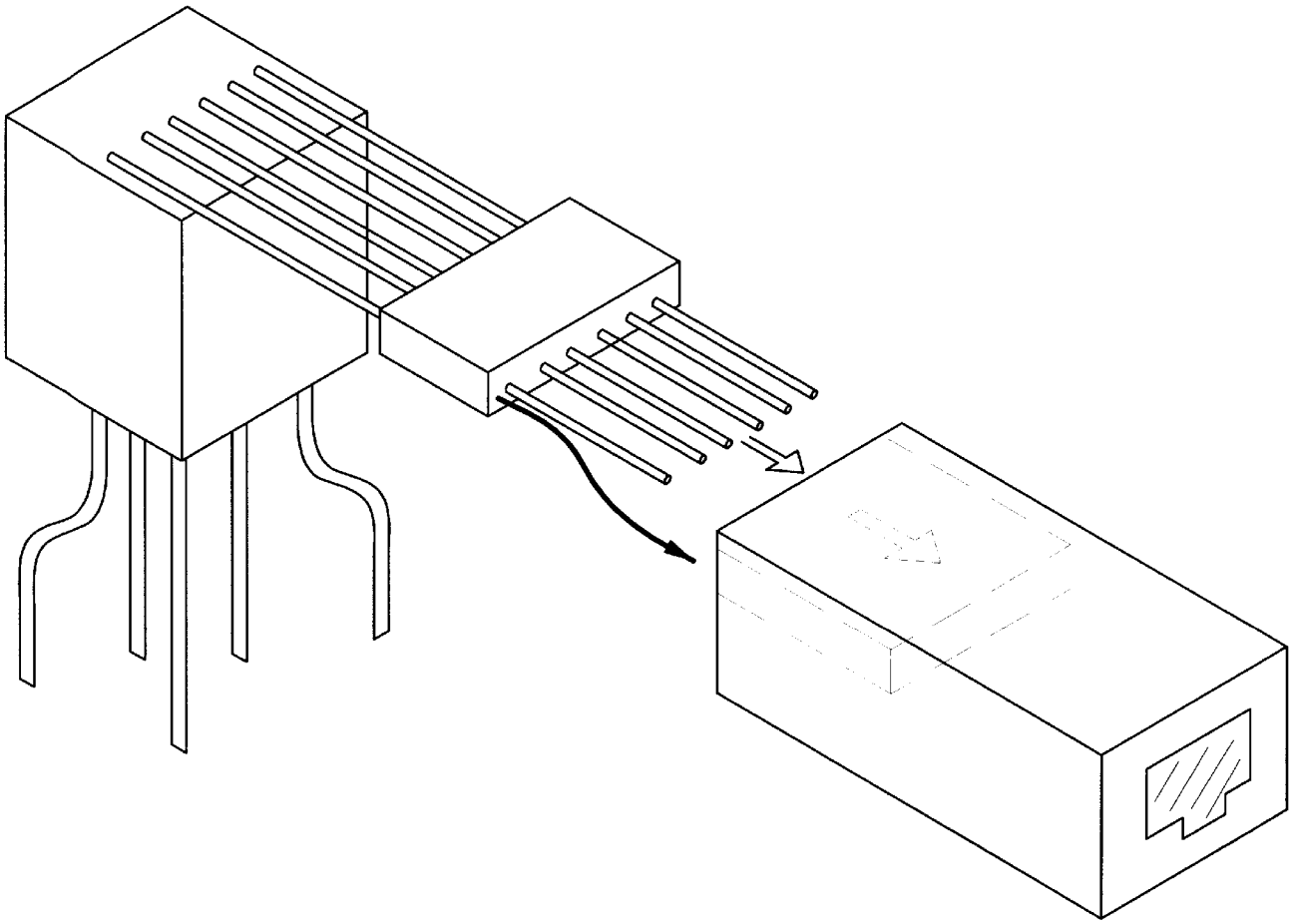
FIG. 1a (PRIOR ART)
FIG. 1*a* is an exploded perspective view of a prior art electrical component connector utilizing a lead carrier assembly.
Figure 1B:
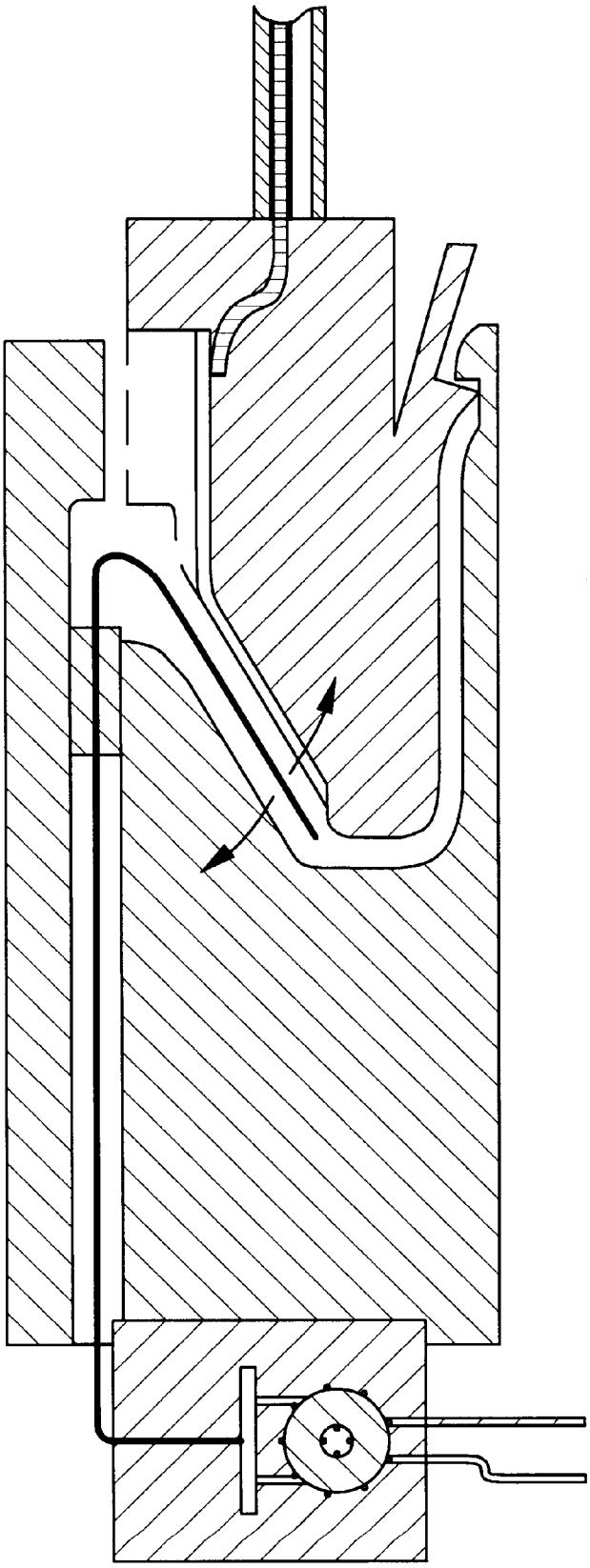
FIG. 1b (PRIOR ART)
FIG. 1*b* is a side elevation view of the prior art connector of FIG. 1*a* with modular plug inserted, showing the relative relationship of the leads, plug contacts, and lead carrier.
Figure 2:
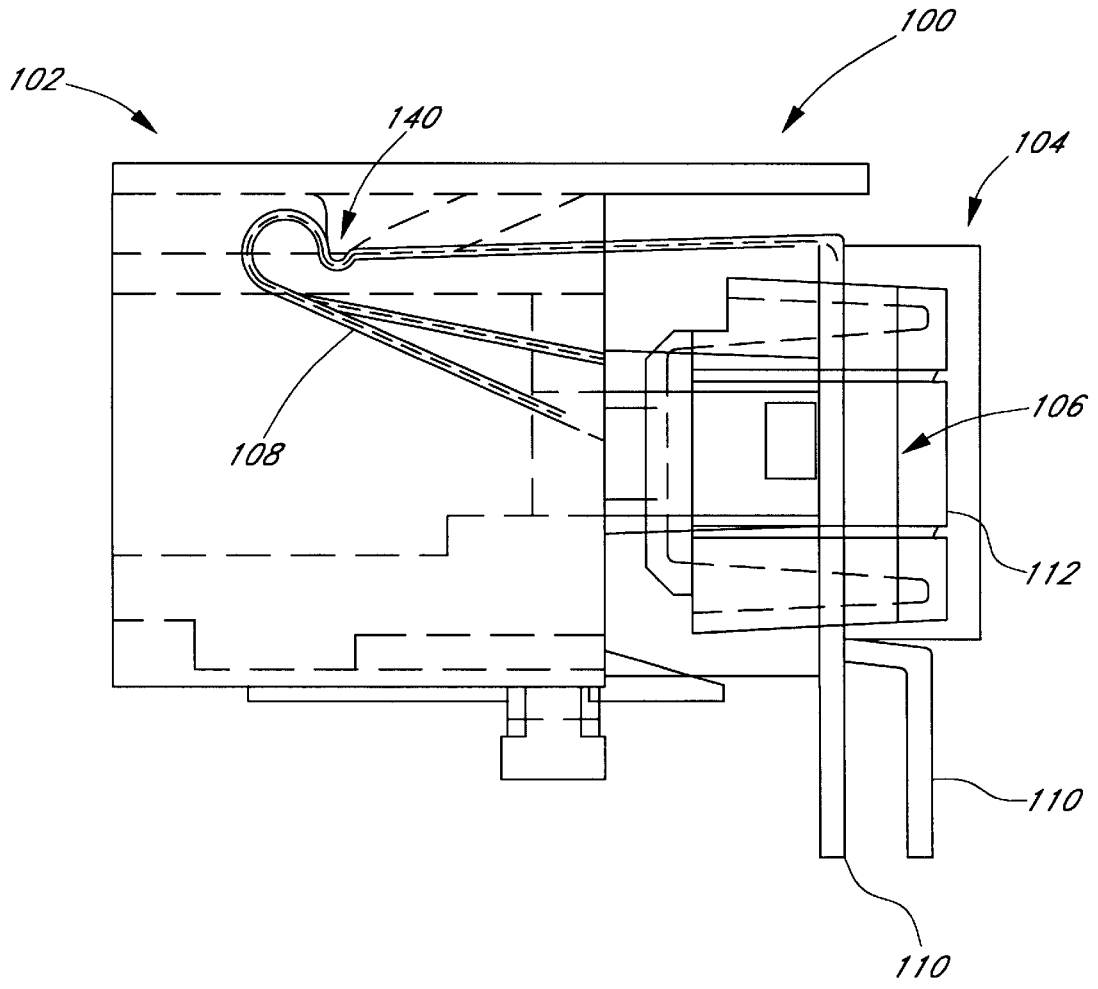
FIG. 2 is a side elevation view of a first embodiment of the microelectronic connector of the present invention, shown completely assembled.

FIG. 2 illustrates a first embodiment of the connector 100 of the present invention in its fully assembled form. The connector 100 is generally comprised of two main components; namely, a first or front connector body element 102 (also known as a "sleeve"), and a second or rear connector body element 104 ("trailer"). As is shown in FIG. 2, one or more electrical component(s) 106 and first and second sets of electrical leads 108, 110 are also integral with the rear body element 104. In the present embodiment, an interlock base 112 of the type well known in the art is utilized as part of the rear body element to house the electrical component (s) 106. The construction and manufacture of such interlock bases are described in detail in, inter alia, U.S. Pat. No. 5,015,981 "Electronic Microminiature Packaging and Method" assigned to Pulse Engineering, Inc., which is incorporated herein by reference in its entirety. Alternatively, however, a number of different methods of electrical component encapsulation and/or mounting may be utilized, such as potting of the component(s) 106 within a cavity (not shown) located within the rear body element 104.

It should also be noted that with respect to the present invention, the term "electrical component" includes, without limitation, (i) discrete components such as resistors, capacitors, and inductors; (2) magneto-electric devices (such as choke coils and transformers); and (3) semiconductive devices.

In the present embodiment, the electrical component 106 is electrically connected to the first set of electrical leads 108 by way of the interlock base leadframe (not shown). Specifically, the first leads 108 are an extension of the leadframe which is part of the interlock base 112. Similarly, the second set of leads 110 are an extension of the interlock base leadframe, yet disposed in a direction different than that of the first leads 108. It can be appreciated, however, that a wide variety of methods of connecting the leads to the electrical component 106 (or interlock base 112) may be used. Additionally, if it is desired to use no electrical component within the connector, the first and second sets of leads 108, 110 may be replaced by one continuous set of leads (not shown).

Figure 3:
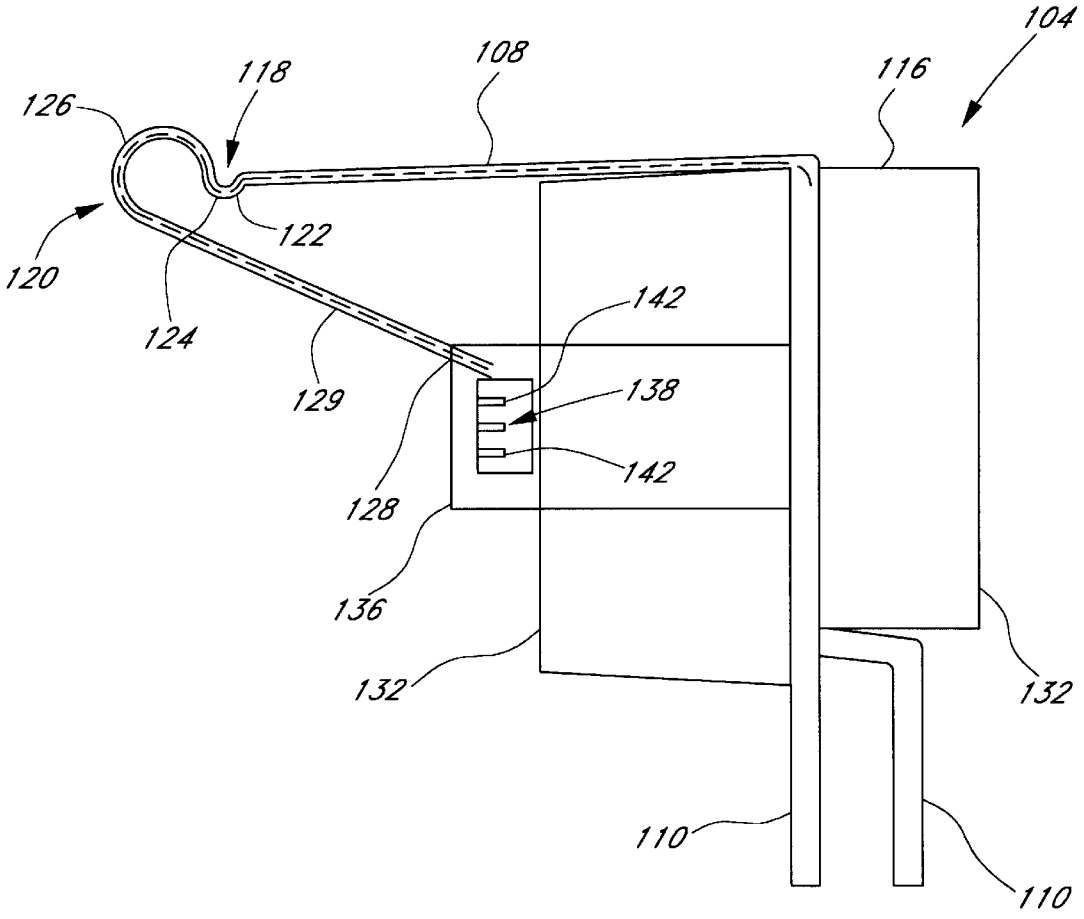
FIG. 3 is a side elevation view of the rear connector body element (trailer) of the connector of FIG. 2.

Referring now to FIG. 3, the structure of the first set of leads 108 of the embodiment of FIG. 2 may be described in detail. As shown in FIG. 3, the first leads 108 are bent at a roughly 90 degree angle in relation to the second set of leads 110 such that the first leads 108 are substantially flush with the top surface 116 of the rear connector body element 104. Additionally, the leads 108 utilize (i) a first lead bend 118 at a first location approximately halfway along their exposed length, and (ii) a second lead bend 120 at a location roughly adjacent to the first location 118. The first lead bend 118 of the leads 108 is made so as to substantially engage the corresponding contour element 140 located within the front connector body element 102 (see FIG. 2). These contour elements 140 are raised, somewhat rounded "bumps" in the present embodiment, although it will be appreciated that other element shapes and configurations (such as notches, tabs, or recesses) may be used.

As shown in FIG. 3, the first lead bend 118 is comprised of a roughly 30 degree bend 122 in a direction away from the contour element 140, followed by a counter-bend 124 of roughly 90 degrees and non-zero radius. The second lead bend 120 is comprised of a substantially circular bend 126 of roughly 210 degrees in a direction opposite to the aforementioned counter bend 124. As a result of the first and second lead bends 118, 120, the distal end 128 of the first leads 108 is disposed at an angle of roughly 150 degrees with respect to the top surface 116 of the rear body element 104. Additionally, the first lead bend 118 is disposed at a location such that when the front body element 102 and rear body element 104 are mated during assembly, the first lead bend 118 for each lead 108 corresponds both longitudinally and laterally to the location of its respective contour element 140. This arrangement provides several advantages, including (i) providing a normal force or bias on a distal portion 129 of each lead 108 which maintains the distal portion 129 in electrical contact with the leads of the modular plug (not shown); (ii) obviating the need for a separate lead carrier (thereby reducing assembly and manufacturing costs), and (iii) creating a restraining bias or force on the first leads 108 such that the front and rear connector elements 102, 104, are held together.

It can also be appreciated that a wide variety of shapes and combinations may be used for the first and second bends 118, 120; the configuration of FIG. 3 is merely illustrative.

As shown in FIG. 3, the second set of leads 110 project from the rear body element 104 project in a generally opposite direction to that of the first leads 108. These second leads 110 are used primarily to electrically connect the connector 100 to an external device (such as a circuit board), although they also provide some degree of mechanical support and stability to the connector 100 when soldered in place. The second leads 110 can be deformed or bent to any desired shape based on the configuration of the external device.

Referring again to FIG. 3, an outer casing 132 of the rear connector body element 104 is formed in the present embodiment so as to enclose the electrical component 106 and portions of the leads 108, 110 immediately adjacent to the interlock base 112. The generally box-like casing 132 is ideally formed from a polymer such as a thermoset plastic using transfer molding techniques well known in the polymer arts, although other materials and formation processes may be used. Additionally, a set of optional locking elements 136 are employed that allow the rear connector body element 104 and associated components to be securely mated to the front connector body element 102. Note that the locking elements may be omitted if desired due to the aforementioned restraining bias created by the cooperation of the shaped leads 108 with their respective contour elements 140. In the embodiment of FIG. 3, the locking elements 136 are formed from the thin metallic leadframe incorporated within the rear body element 104. The locking elements further include an aperture 138 with a series of tabs 142 that alternately extend out of the plane of their respective locking element 136 and that allow the locking element to engage ridges located within respective slots 146 in the front connector body element (see discussion of FIGS. 4–7 below) such that the front and rear body elements 102, 104 "snap" together. The locking elements 136 prevent subsequent separation of the body elements 102, 104, thereby increasing the reliability of the connector 100.

Referring now to FIGS. 4 through 7, the front connector body element of the embodiment of FIG. 2 may be described in detail. The front connector body element ("sleeve") is generally box-like in shape, and is comprised of a front surface 150 and rear surface 152, as well as two side surfaces 154,156, a top surface 158 and bottom surface 160. Additionally, an optional electrical isolator 161 is formed along the interface of the top and rear surfaces, and is configured to lie essentially coplanar with the top surface 158. While the illustrated embodiment of the front connector body element 102 uses a box-like structure, it will be recognized that other shapes and configurations may be used. The front connector element 102 is ideally formed from nylon using an injection molding process of the type well known in the art, although other materials and processes may be substituted.

Figure 7:
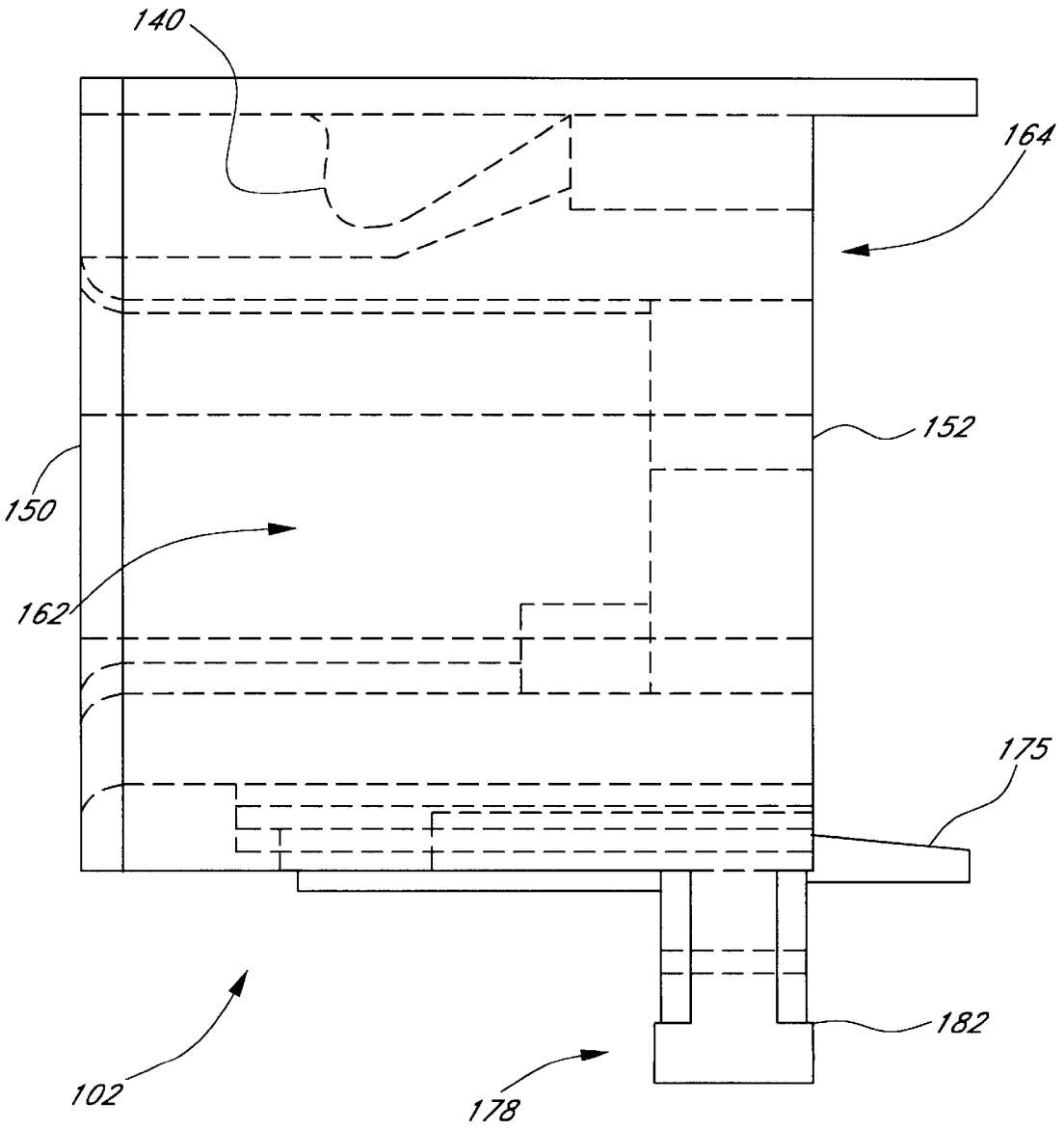
FIG. 7 is a side elevation view of the connector body element of FIG. 4.

The front and rear surfaces 150,152 of the present embodiment are planar and substantially parallel. The connector body element 102 further includes a cavity 162 that communicates with the front and rear surfaces 150,152. The front surface 150 and cavity 162 are adapted to receive a modular plug having electrical leads or contacts such as RJ 45 or RJ 11 type, although others may be used. The rear surface 152 communicates with the cavity 162 via a specially designed aperture 164. The aperture 164 is located near the top surface 158, and includes two sets of vertical fingers 166*a*, 166*b* that act to guide, separate, and insulate the first electrical leads 108 of the rear connector body element 104 during assembly and connector operation. One set of fingers 166*a* is formed on the bottom of the top surface 158, and extends substantially into the cavity 162. The set of fingers 166*a* also protrudes downward into the aperture 164. The other set of fingers 166*b* are formed as part of the rear surface 152, and extend partially into the cavity 162. The fingers 166*b* also protrude upward into the aperture. Referring to FIG. 7, a series of contour elements 140 ("bumps") are formed within the cavity 162 on the underside of the top surface 158. These contour elements 140 correspond to the individual electrical leads 108 of the rear connector element 104 and are aligned with the interstices between the upper fingers 166*a* in the aperture 164 such that the electrical leads 108 directly encounter the contour elements 140 when the connector elements 102, 104 are being assembled. As previously described, the shape of the first electrical leads 108 substantially matches the contour of the contour elements 140 such that the contour elements 140 engage and retain the electrical leads 108 in position when the connector 100 is assembled (see FIG. 2). The contour elements 140 further bias their respective leads 108 downward into the cavity such that the contour element 140 and lead bends 118,120 cooperate to maintain the distal end 128 of the leads 108 in contact with corresponding electrical leads (not shown) on the modular plug received within the cavity 162.

Figure 6:
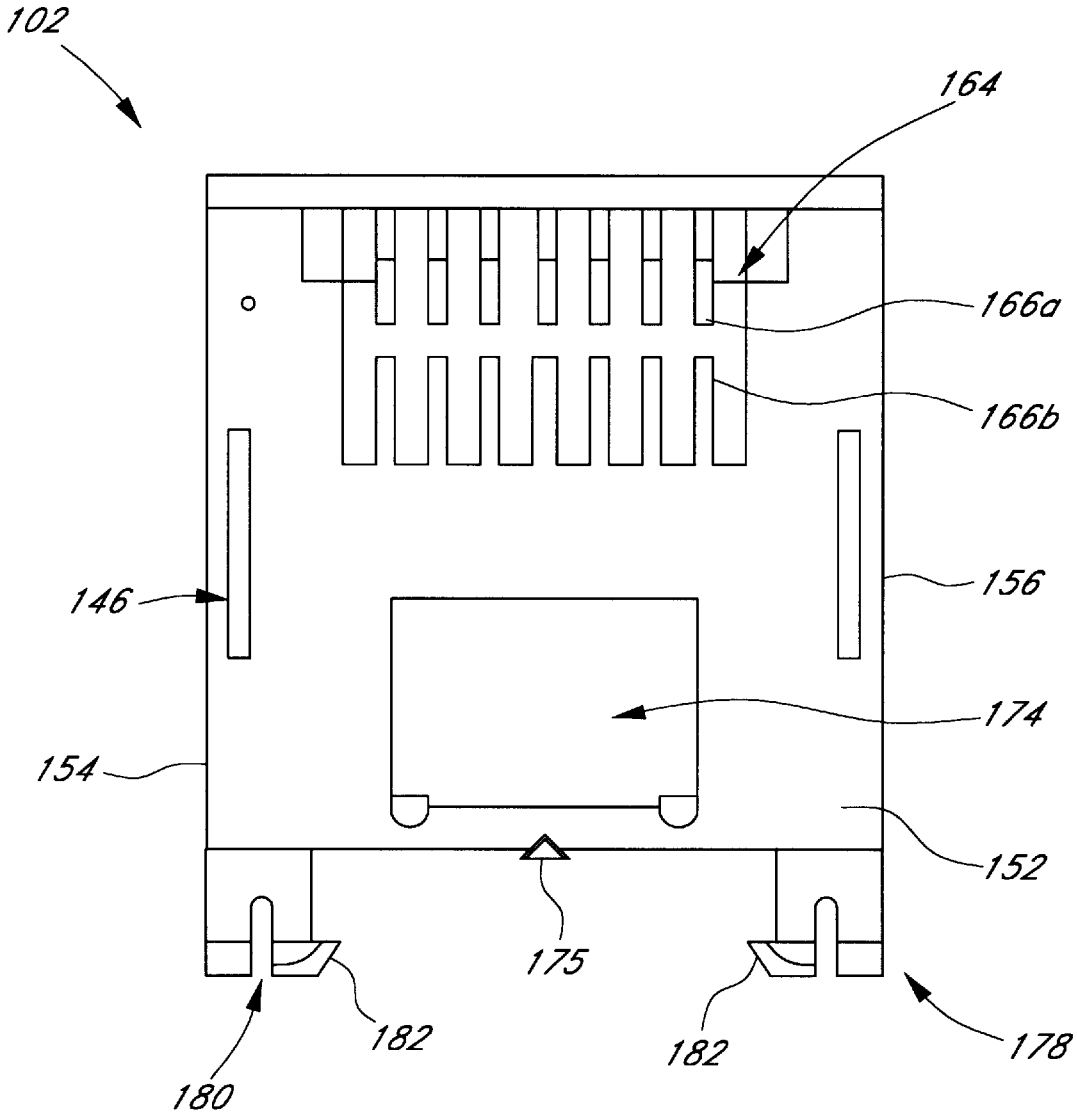
FIG. 6 is a rear elevation view of the connector body element of FIG. 4.

In reference to FIG. 6, it is seen that two slots 146 with optional internal ridges (not shown) are also located on the rear surface 152 and are each oriented vertically near one of the side walls 154, 156 so as to coincide with the locations of their respective locking elements 136 mounted on the rear connector body element 104. These slots 146 frictionally receive the locking elements 136, thereby allowing a firm mechanical bond between the front and rear body elements. This locking arrangement obviates the use of adhesives during the manufacturing process, although such adhesives may be used for further assurance of component rigidity if desired.

The rear surface 152 further includes a window 174 useful for viewing descriptive information or trademarks positioned on the trailer 104 when the connector 100 is installed (without modular plug) within an electronics housing or device, since no external surfaces of the connector 100 are typically visible in such applications.

Also located on the rear surface 152 is an optional support tab 175 that cooperates with a corresponding recess (not shown) in the rear connector body to provide additional mechanical stability and alignment for the connector body elements when assembled. While generally triangular in cross-section in the present embodiment, a variety of different shapes and configurations may be used.

As further shown in FIGS. 4–7, the front connector body element 102 of the present invention includes one or more mounting elements 178 disposed on its bottom surface 160. These mounting elements 178 facilitate attachment of the connector 100 to an external device such as a printed circuit board 190 (see FIG. 8). The mounting elements 178 of the present embodiment are split-end pins having an end gap 180 and retainer 182. The flexibility of the front connector body element material, the end gap 180, and the retainer 182 all cooperate to allow the mounting pins 178 to be "snapped" into their respective mounting holes 192 and retained therein. These features further permit subsequent removal of the connector 100 from the circuit board 190 when desired.

Figure 4:
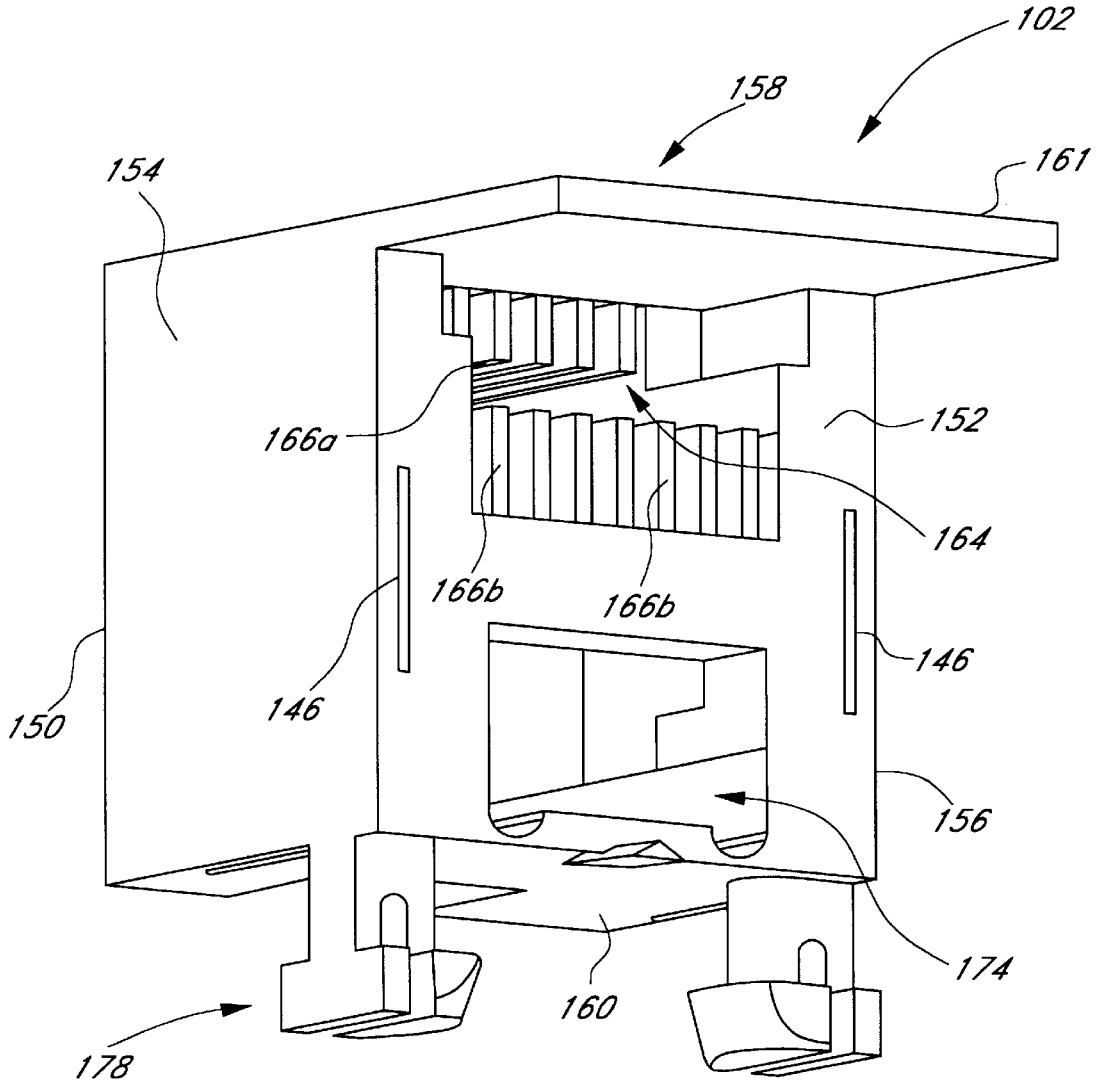
FIG. 4 is a perspective view of the front connector body element (sleeve) of the connector of FIG. 2.
Figure 5:
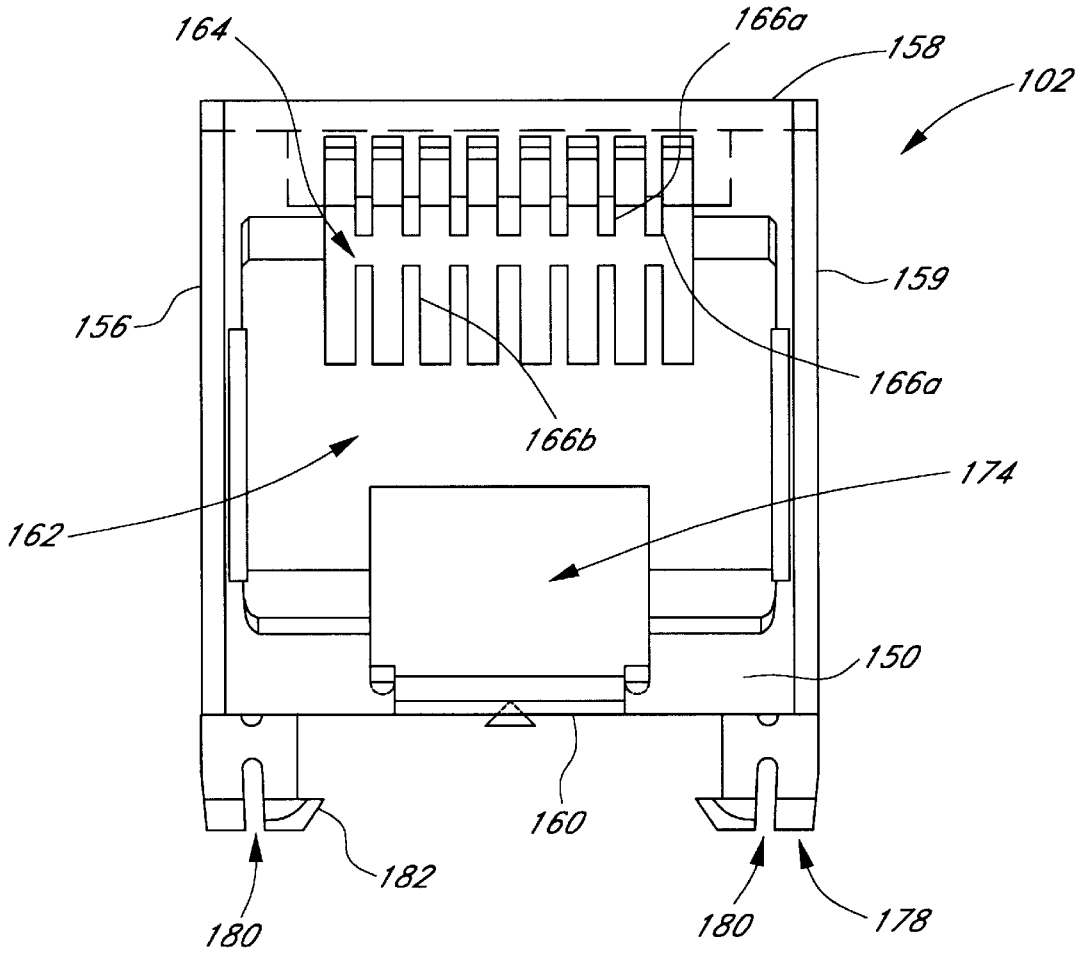
FIG. 5 is a front elevation view of the connector body element of FIG. 4.
Figure 8:
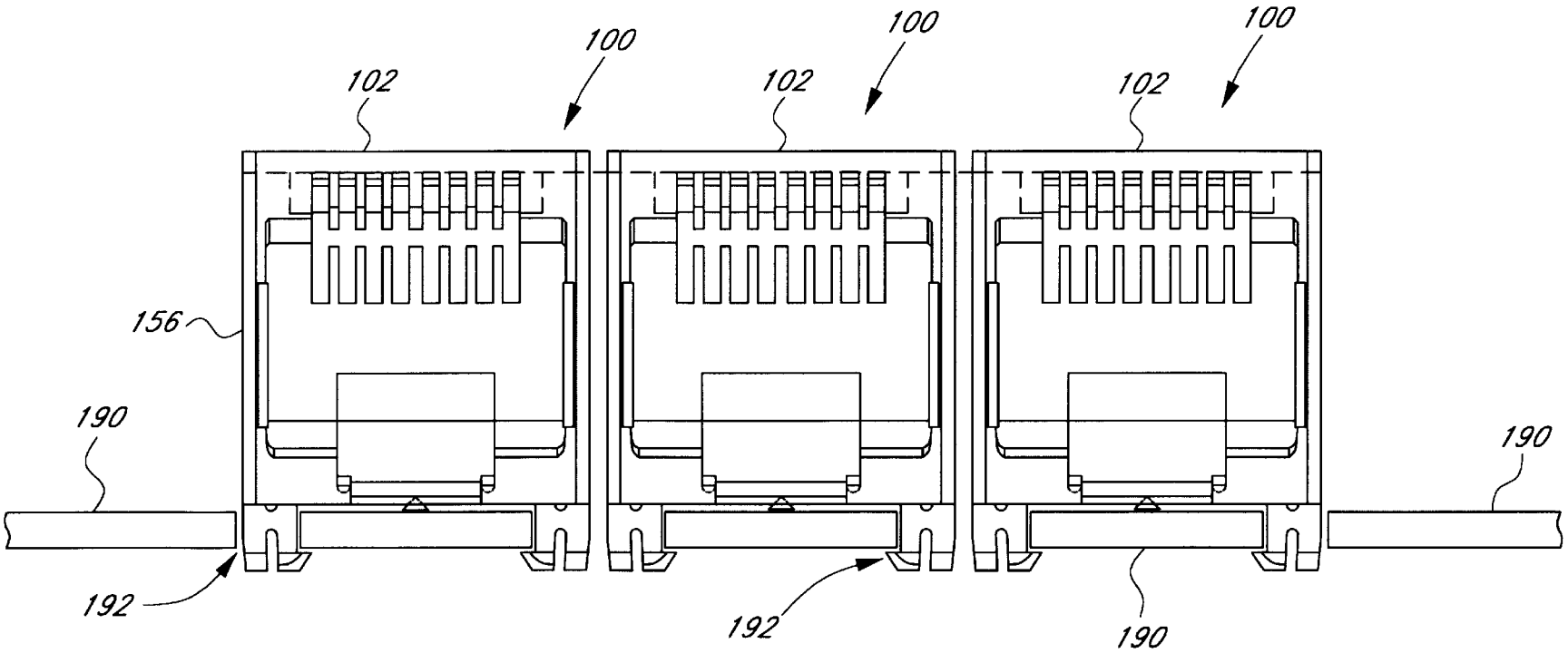
FIG. 8 is a front elevation view of the connector of FIGS. 2–7 showing the connector mounted adjacent to similar connectors on a printed circuit board.
Figure 9:
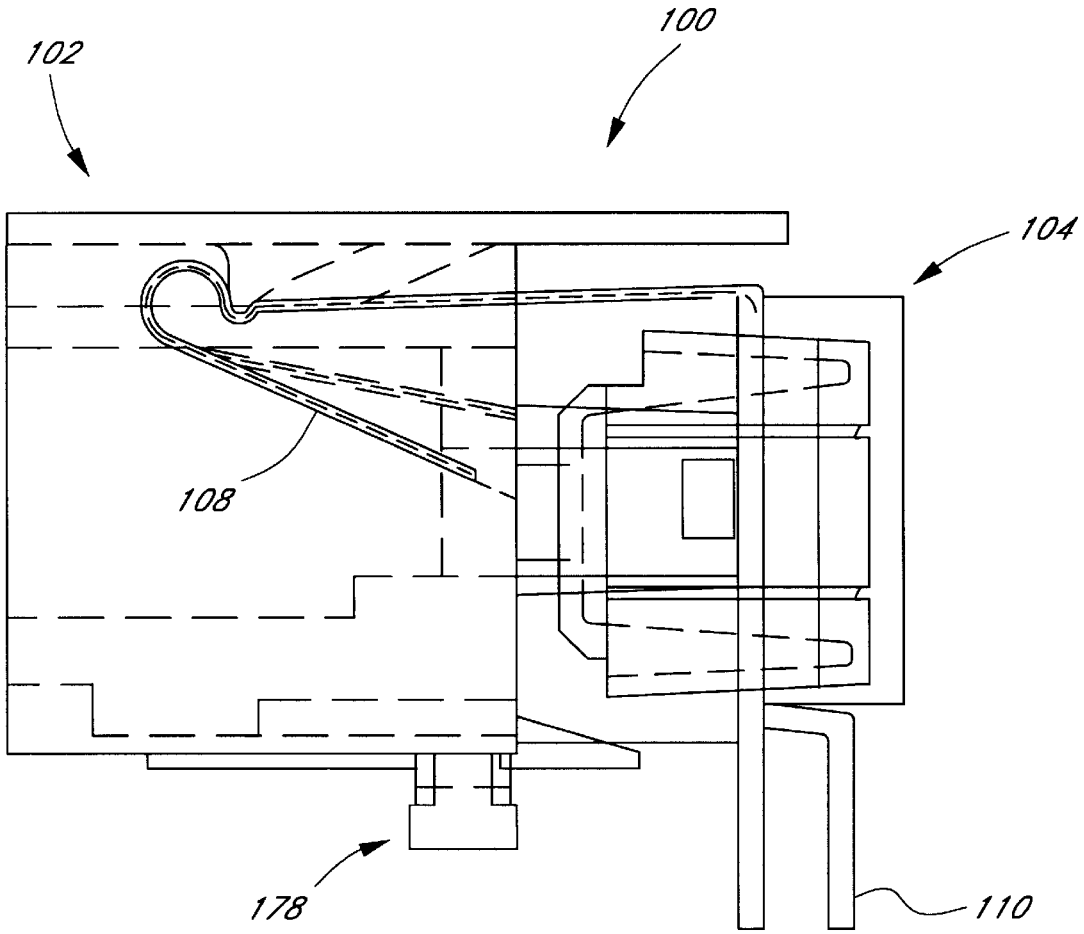
FIG. 9 is a side elevation view of a second embodiment of the microelectronic connector of the present invention, shown completely assembled.
Figure 10:
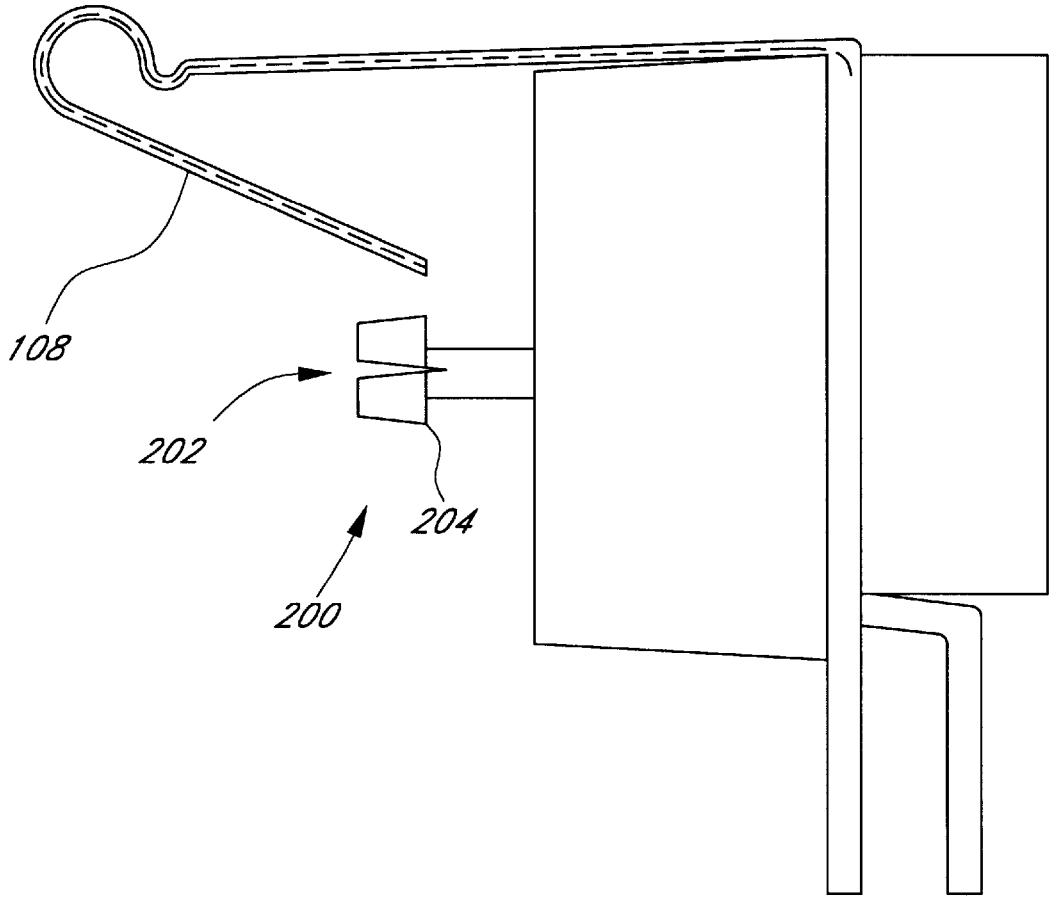
FIG. 10 is a side elevation view of the rear connector body element (trailer) of the connector of FIG. 9.
Figure 11:
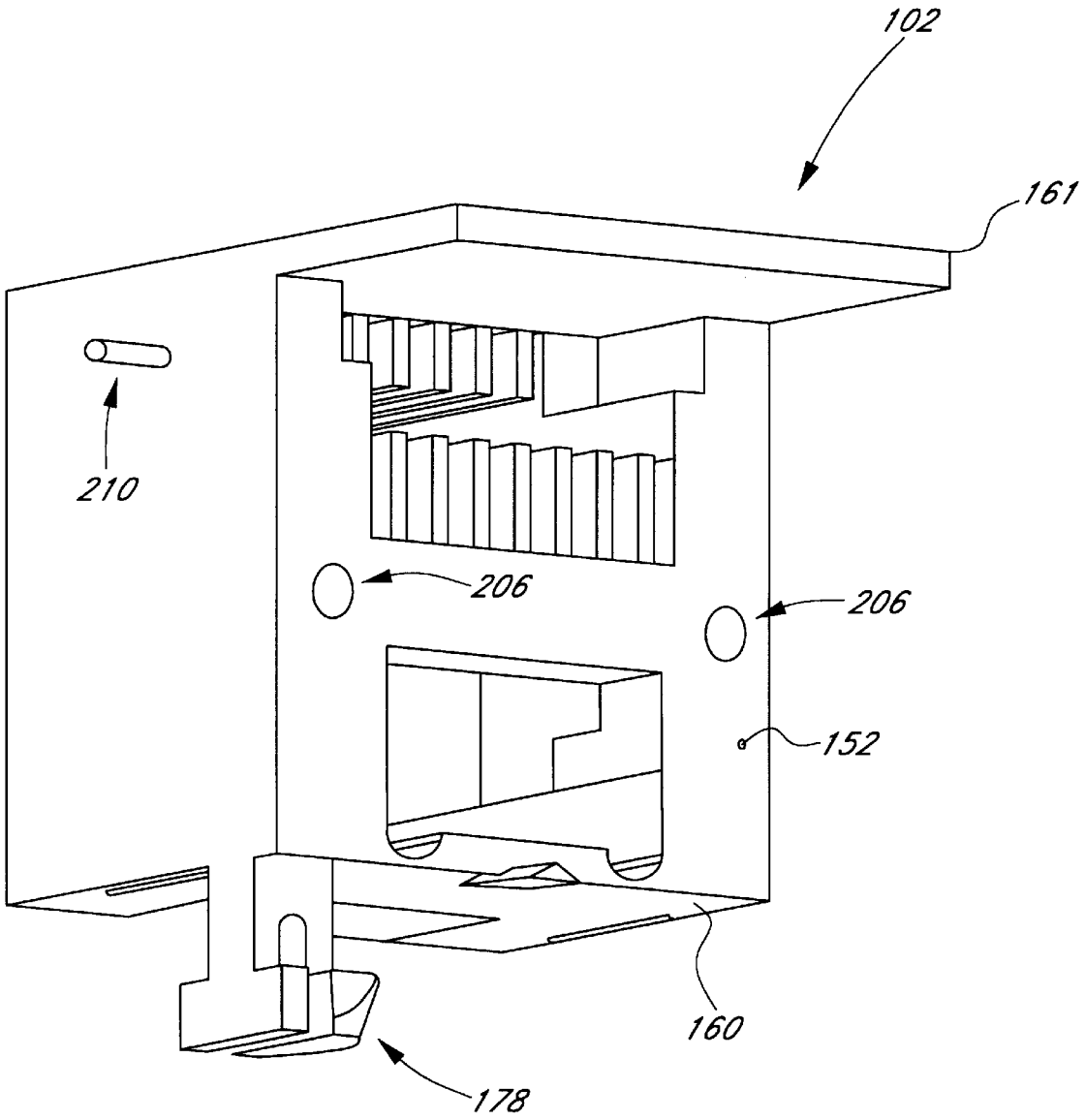
FIG. 11 is a perspective view of the front connector body element (sleeve) of the connector of FIG. 9.
Figure 12:
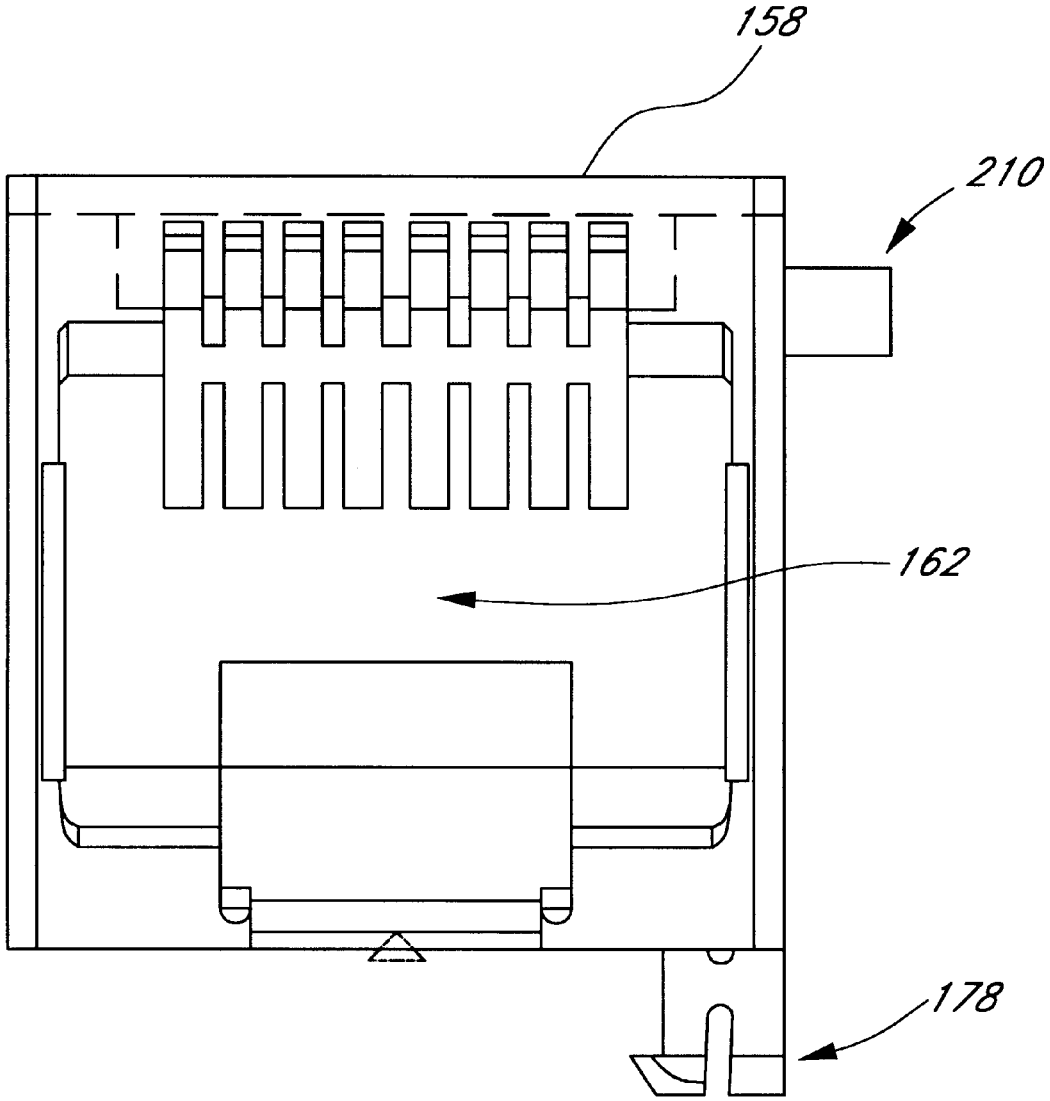
FIG. 12 is a front elevation view of the connector body element of FIG. 11.

The pins 178 are located essentially flush with the front connector body element side walls 154,156, and are truncated ("flat-sided") on their outer edge so that the side wall and pin form a continuous, planar surface as shown in FIGS. 4–6. Hence, when multiple connectors 100 are placed in a tandem configuration as shown in FIG. 8, their adjacent mounting pins 178 form a single, elliptically shaped pin. This mounting arrangement provides (i) mechanical stability to the connector, especially when force is placed on the connector body such as during modular plug insertion or removal; (ii) a minimal lateral dimension or profile when using multiple connectors in tandem, and (iii) reduced manufacturing cost since only one mounting hole is required in the external device for every two mounting pins.

FIGS. 9–14 illustrate a second embodiment of the microelectronic connector of the present invention. As illustrated, this second embodiment utilizes two locking pins 200 (FIG. 10) with end gaps 202 and retainers 204 as opposed to the slot and tab arrangement of the first embodiment (FIGS. 2–7). The pins 200 are frictionally received by two corresponding holes 206 located in the rear surface 152 of the front connector body element 102. An internal ridge within the holes 206 (not shown) is used to engage the retainers 204 to prevent separation of the front and rear connector body elements 102, 104.

Figure 13:
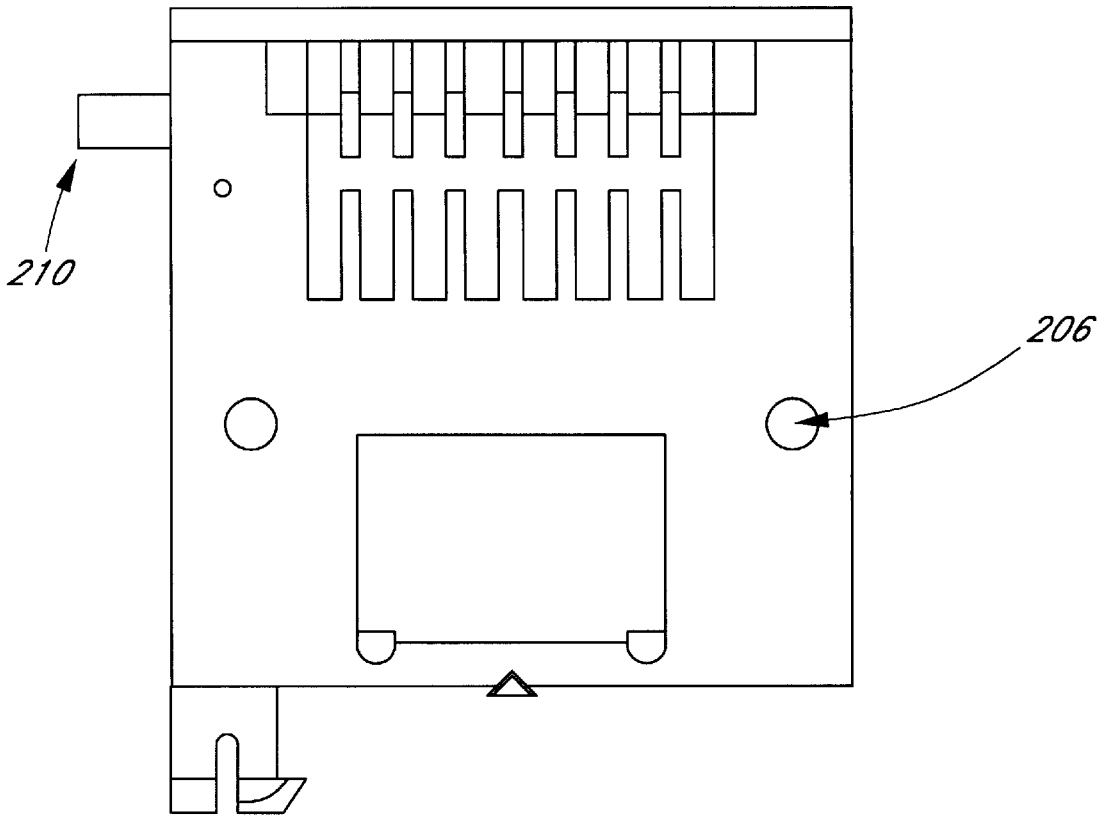
FIG. 13 is a rear elevation view of the connector body element of FIG. 11.
Figure 14:
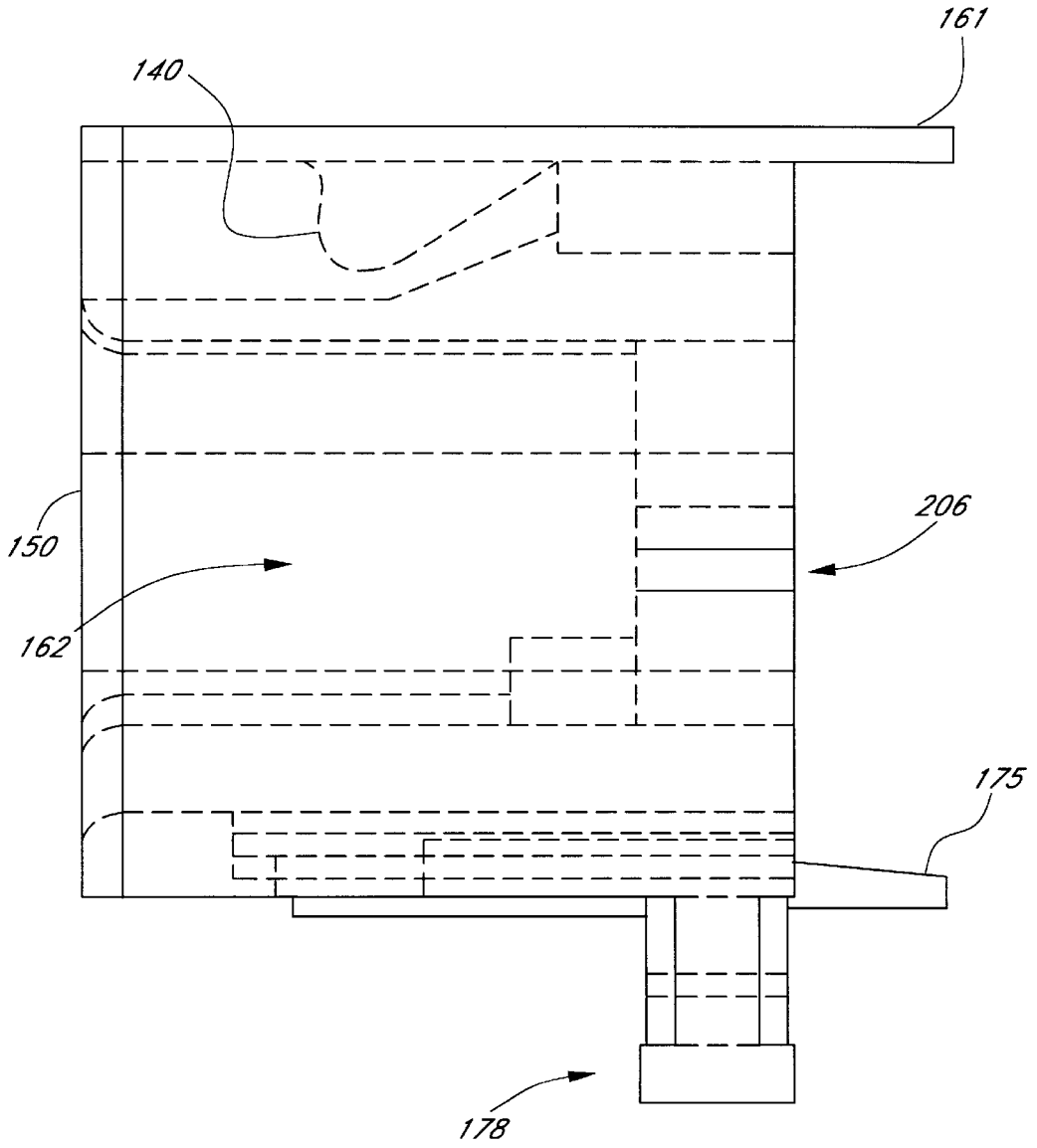
FIG. 14 is a side elevation view of the connector body element of FIG. 11.
Figure 15:
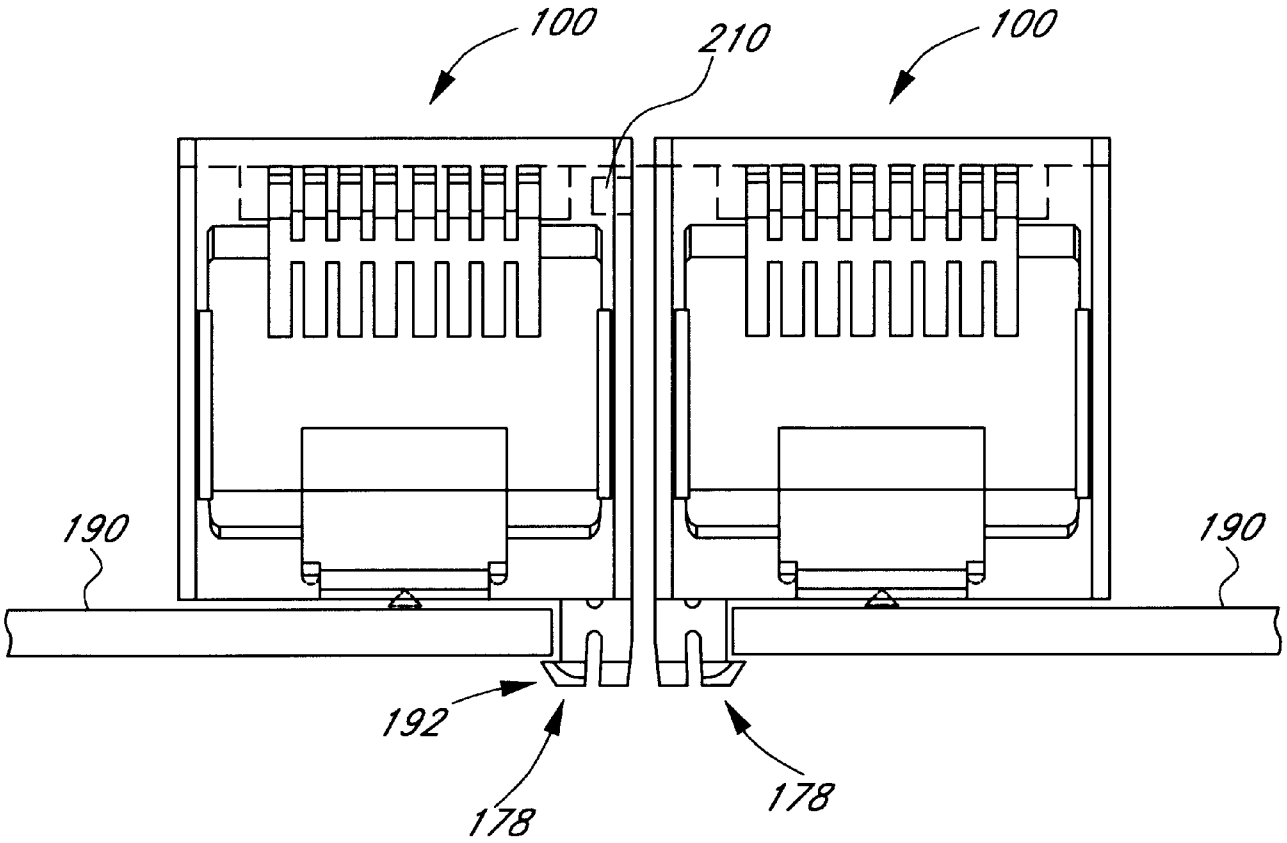
FIG. 15 is a front elevation view of the connector of FIGS. 9–14 showing the connector mounted adjacent to a similar connector on a printed circuit board.

Additionally, the second embodiment of FIGS. 9–14 utilizes a single mounting pin 178 as opposed to two or more in the first embodiment. This arrangement allows two connectors having mounting pins on adjacent sides to be mounted in tandem using only one mounting hole. A separate dowel 210 as shown in FIG. 13 is provided on one of the two connectors to be mounted; this dowel provides mechanical stability to the connector pair in the absence of additional mounting pins 178. A corresponding recess (not shown) is provided on the tandem connector to receive the dowel 210. Accordingly, the connectors are asymmetric in two respects: 1) the mounting pin 178 for each connector is basically a "mirror image" of that on the other connector, and 2) one connector has a dowel 210, and one has a recess. This mounting arrangement is further illustrated in FIG. 15. This embodiment is especially useful where only two connectors are being mounted to the circuit board (or for the end connectors in a series of tandem connectors), since it obviates the need to create additional mounting holes to receive the additional mounting pins associated with the first embodiment, and permits the use of mounting holes of only one shape and size.

Method of Manufacture

Figure 16:
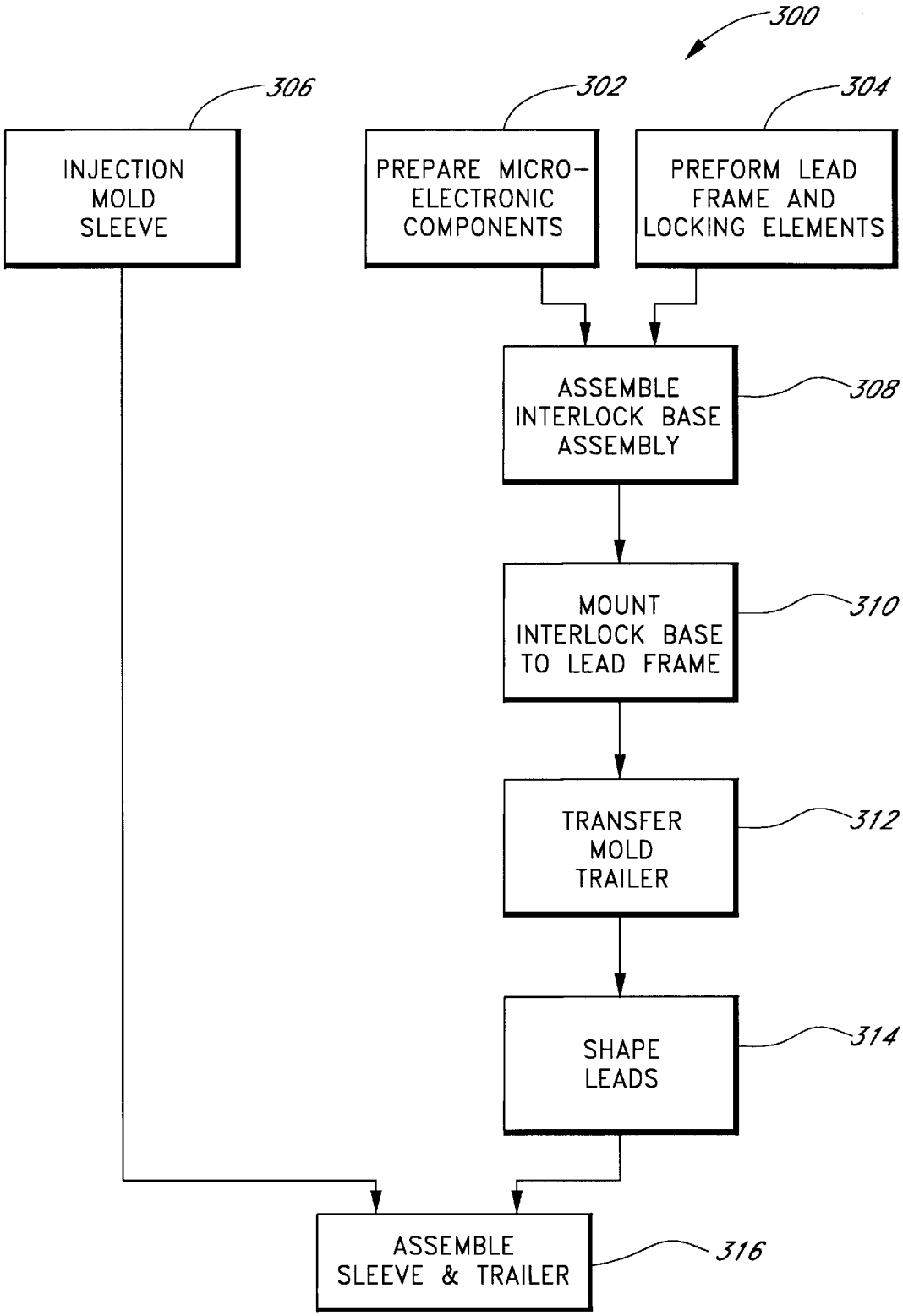
FIG. 16 is a logical flow diagram illustrating the general manufacturing process for the connector of the present invention.

Referring now to FIG. 16, a method of manufacturing the improved microelectronic connector of the present invention is disclosed. As shown in FIG. 16, the method 300 is comprised generally of a series of process steps, several of that may be permuted in order or performed in parallel with other steps. Furthermore, not all steps need be performed, and alternative steps may be substituted for many of those shown. For example, if the use of a potted electrical component 106 (as opposed to an interlock base assembly) is desired, the process steps relating to preparation and assembly of the interlock base 112 may be deleted, and corresponding steps relating to preparation of the component 106 and potting within the rear connector body 104 element substituted. FIG. 16 illustrates but one exemplary process of this method 300.

Referring again to FIG. 16, one embodiment of the manufacturing process begins at a first process step 302 that involves the preparation of the electrical components such as transformers or choke coils. Several sub-steps may be involved in the first process step 302, including twisting of the component conductors, winding the transformer/choke coils, twisting center taps, solder dipping, baking the coils, and adding a silicone coating. The first process step 302 is performed in parallel with the second process step 304, which is preparation of the leadframe. This step 304 involves preforming the metallic leadframe prior to insertion onto the interlock base 112, and the formation of the locking elements 136 and associated retaining tabs 142. In parallel with the first two process steps 302, 304 of FIG. 16, the front connector body element 102 is formed using conventional injection molding techniques in a third process step 306.

Next, the interlock base is assembled in a fourth step 308. This process step 308 is generally comprised of applying a silicone coating to the base, loading the electrical components into the base, curing the silicone, and routing the component wires. The detailed assembly of the interlock base is further described in the above-referenced U.S. Pat. No. 5,015,981.

In the fifth process step 310, the leadframe is inserted onto the interlock base. Preforming of the leadframe in the second process step 304 allows easy insertion of the leadframe onto the base. In the sixth process step 312, the entire interlock base, leadframe, and assembly is transfer molded to form the unitary rear connector body element 104 as previously described.

In the seventh process step 314, the first and second leads 108, 110 are shaped as previously described. Lastly, in the eighth process step 316, the finished rear body element 104 ("trailer") is inserted and snapped into the front body element 102 ("sleeve") formed in the third process step 306 described above. The finished connector is then inspected and tested as necessary to ensure product quality prior to shipping.

Figures 17, 17A:
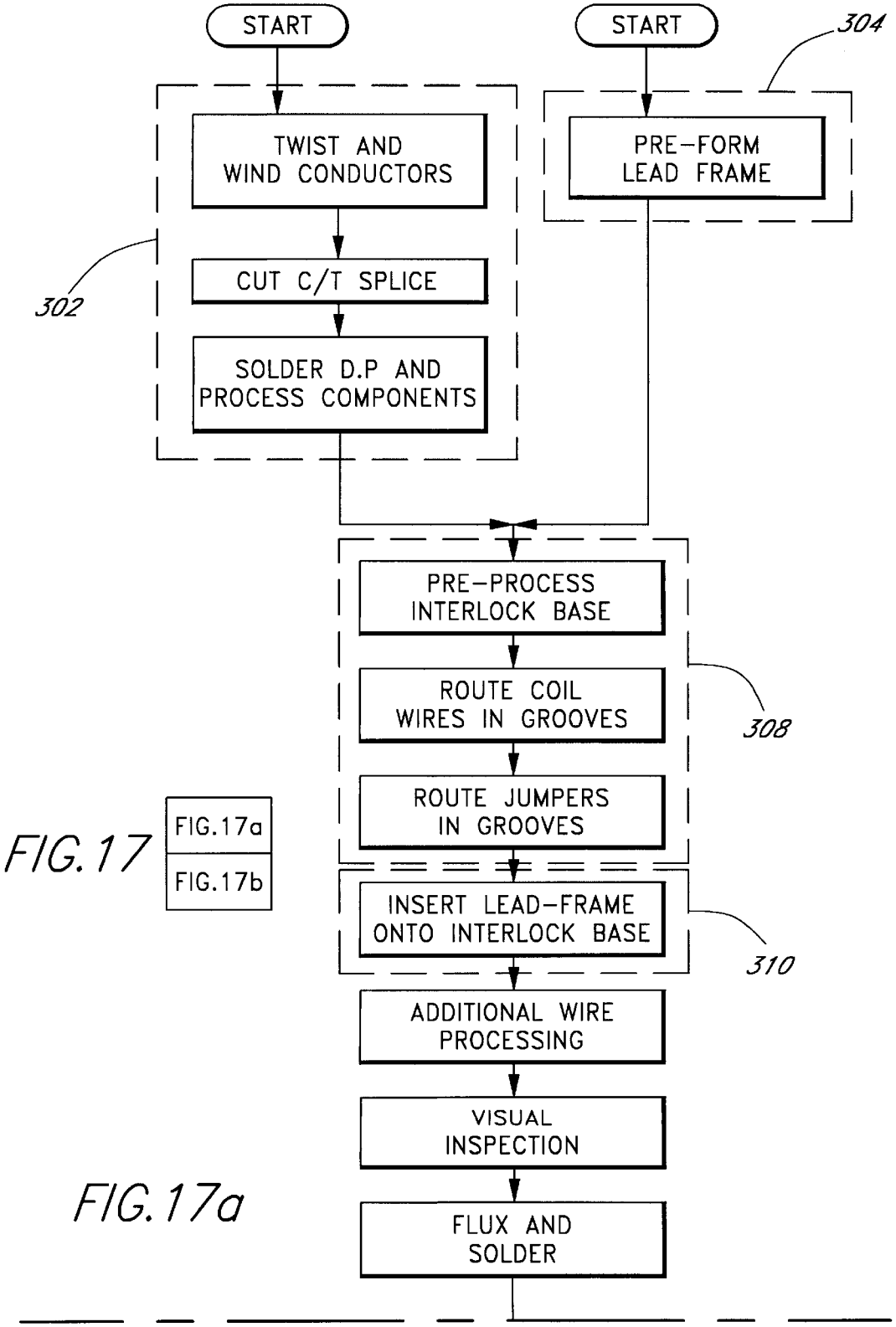
FIG. 17 is a detailed process flow diagram illustrating several aspects of the manufacturing process of FIG. 16.
Figure 17B:
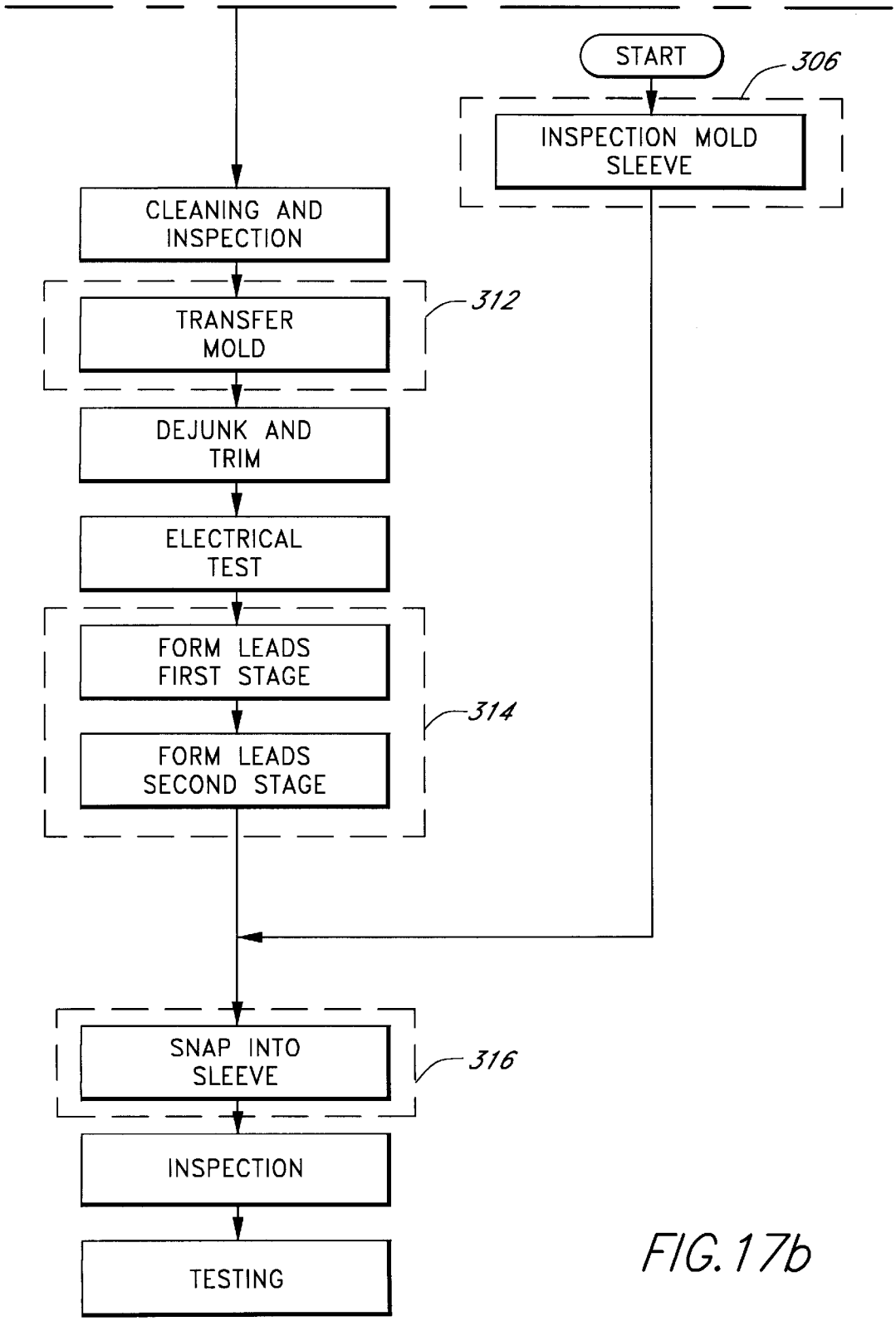

FIG. 17 further illustrates the detailed substeps associated with the process steps of FIG. 16 for the exemplary case of a connector employing a microelectronic transformer or choke coil within an interlock base assembly. As shown in FIG. 17, process step 302 includes sub-steps that include winding the transformer and choke coil cores, and splicing and dip-soldering the leads. Process step 308 generally comprises preparing and loading the interlock base on an assembly fixture, installing the coils prepared in process step 302 above, and routing the coil leads and jumpers within the channels or grooves of the interlock base. After the preformed leadframe is attached to the prepared interlock base per process step 310, the interlock base assembly is further processed (e.g., cleaned, inspected, fluxed and soldered) prior to being transfer molded within the trailer per process step 312. Marking, trimming of the lead frame tie bars, and electrical testing is then performed, and then the first and second electrical leads are formed per process step 314. The completed trailer is then snapped into the sleeve in process step 316, after which final inspection and testing of the assembled connector are performed.

While the above detailed description has shown, described, and pointed out novel features of the invention as applied to various embodiments, it will be understood that various omissions, substitutions, and changes in the form and details of the device or process illustrated may be made by those skilled in the art without departing from the spirit of the invention.

What is claimed is:

1. A microelectronic connector assembly comprising:

a first connector body having a cavity adapted to receive a modular plug therein;

at least one contour element within said cavity;

an aperture communicating with said cavity;

a second connector body mateable to said first connector body, said second connector body including at least one electrical lead having a bend, wherein said at least one electrical lead is inserted at least partly into said cavity, said bend cooperating with said contour element to maintain said at least one lead in contact with said modular plug.

2. The connector of claim 1, wherein said contour element is integrally molded with said first connector body.

3. The connector of claim 1, wherein said first connector body is mated to said second connector body using a locking tab and slot arrangement.

4. The connector of claim 1, wherein said second connector body includes an interlock base.

5. The connector of claim 1, wherein said connector further includes at least one mounting element attached to said connector body for mounting said connector to an external device, said at least one mounting element being flush with at least one of said side surfaces of said connector body, and wherein adjacent ones of said mounting elements on adjacent connectors can be received by one aperture located in said external device.

6. The connector of claim 1, wherein said modular plug is an RJ type modular plug.

7. The connector of claim 6, wherein said modular plug is an RJ 45 plug.

8. The connector of claim 1, wherein said first connector body comprises a polymer.

9. The connector of claim 8, wherein said first connector body is injection molded.

10. The connector of claim 1, wherein said bend is comprised of at least two individual bends located in adjacent regions of said at least one electrical lead.

11. The connector of claim 10, wherein said individual bends include;

a first bend having a cross-sectional profile which is substantially similar to that of said contour element; and a second bend being semi-circular in cross-section, said first bend and said second bend cooperating such that the distal end of said electrical lead is maintained within said cavity and in an angular relationship to said second exterior surface of said first connector body.

12. The connector of claim 1, wherein said first connector body includes at least one mechanism for mounting said connector to another component.

13. The connector of claim 12, wherein said at least one mechanism is a split-end pin having a retainer.

14. The connector of claim 1, wherein said second connector body includes at least one electrical component.

15. The connector of claim 14, wherein said at least one electrical component is a magnetic component.

16. A microelectronic connector assembly for receiving a modular plug having electrical leads, comprising:

a connector body having a first side and a second side;

a cavity open to said first side, said cavity having an interior surface and substantially receiving said modular plug;

an aperture communicating with said cavity and said second side;

at least one contour element attached to said interior surface of said cavity;

a trailer communicating with said second side of said connector body, said trailer having an electrical component;

a plurality of first leads electrically connected to said electrical component, at least one of said plurality of first leads having a bend, said bend engaging said contour element within said cavity, said contour element retaining said first leads within said cavity and said trailer in substantial communication with said connector body, said contour element further cooperating with said bend to maintain said first leads in contact with said electrical leads of said modular plug; and a plurality of second leads electrically connected to said electrical component, said second leads defining an electrical path so as to enable electrical connection of said microelectronic connector to an external device.

17. The connector of claim 16, wherein said external device is a circuit board.

18. The connector of claim 16, wherein said electrical component is a magnetic component.

19. A method of manufacturing a microelectronic connector, comprising:

forming a first connector body having:

a cavity adapted to receive a modular plug, said plug having a plurality of first electrical leads, and a plurality of contour elements located within said cavity;

forming a second connector body having:

an electrical component contained substantially therein, and a plurality of second electrical leads, said second leads being electrically connected to said electrical component;

configuring each of said second leads in a shape which substantially engages respective ones of said contour elements of said first connector body upon mating; and mating said second connector body to said first connector body, said second leads being inserted at least partly into said cavity such that said shape of said second leads cooperates with respective ones of said contour elements.

20. The method of claim 19, wherein the act of configuring each of said second leads in a shape comprises:

forming a first bend having a cross-sectional profile which is substantially similar to that of said contour element; and forming a second bend that is substantially circular in cross-section, said first bend and said second bend cooperating such that the distal end of said electrical lead is maintained within said cavity and in an angular relationship to said second exterior surface of said first connector body element.

21. The method of claim 20, wherein the act of forming said first bend comprises forming bends of between 15 and 45 degrees in a direction away from said contour element, followed by a counter-bend of between 45 and 120 degrees and non-zero radius, and wherein the act of forming said second bend comprises forming a substantially circular bend of between 180 and 230 degrees in a direction opposite to said counter-bend of said first bend.

22. The method of claim 19, wherein the act of configuring said second leads comprises forming said second leads and said contour elements in a configuration such that said second leads and said contour elements cooperate to maintain said second leads in contact with said first leads of said modular plug when said plug is inserted in said cavity.

23. The method of claim 19, wherein the act of forming said first connector body comprises the use of a molding process.

24. The method of claim 19, wherein the act of forming said second connector body comprises the use of a transfer molding process.

25. The method of claim 19, wherein the act of forming of said second connector body element includes the act of forming an interlock base.

26. The method of claim 19, wherein said modular plug is an RJ type modular plug.

27. A method of manufacturing a microelectronic corrector, comprising:

forming a first connector body element having a first surface and second surface, a cavity communicating with said first surface, an aperture communicating with said cavity and said second surface, and a plurality of contour elements located within said cavity;

forming a second connector body element having an electrical component contained substantially therein, and a plurality of leads having respective distal ends, said leads being electrically connected lo said electrical component;

configuring said leads of said second connector body element to define a bend in each lead, said bends being shaped to cooperate with respective ones of said contour elements of said first connector body upon assembly; and mating said second connector body element to said first connector body element, said leads of said second body element being inserted into said aperture via said second surface such that said bends in said leads engage respective ones of said contour elements, and said distal ends of said leads are disposed substantially within said cavity.

28. A microelectronic connector assembly comprising:

a first connector body having a first and second exterior surface;

a cavity communicating with said first exterior surface for receiving a modular plug substantially therein;

at least one contour element within said cavity;

an aperture communicating with said cavity and said second exterior surface;

a second connector body mateable to said first connector body, said second connector body including at least one electrical lead having a bend, wherein said at least one electrical lead is inserted at least partly within said aperture and said cavity, said bend cooperating with said contour element to maintain said at least one lead in contact with said modular plug.

29. A microelectronic connector manufactured by the process comprising the steps of:

forming a first connector body having a first surface and second surface, a cavity communicating with said first and second surfaces, said first surface and said cavity being adapted to receive a modular plug, and a plurality of contour elements located within said cavity;

forming a second connector body having an electrical component contained substantially therein, and a plurality of leads having respective distal ends, said leads being electrically connected to said electrical component;

configuring said leads of said second connector body to define a bend in each lead, said bends being shaped to cooperate with respective ones of said contour elements of said first connector body upon mating; and mating said second connector body to said first connector body, said leads of said second body being inserted into said cavity via said second surface such that said bends in said leads engage respective ones of said contour elements, and said distal ends of said leads are disposed substantially within said cavity.

30. A reduced profile microelectronic connector comprising:

a connector body having two side surfaces;

a cavity disposed within said connector body, said cavity having of plurality of contour elements formed therein and being adapted to receive a modular plug;

an electrical component;

a plurality of first electrical leads disposed at least partly within said cavity and electrically connected to said electrical component, each of said plurality of first electrical leads having a bend formed therein, said bends cooperating with respective ones of said plurality of contour elements;

a plurality of second electrical leads electrically connected to said electrical component and configured to electrically connect said connector to an external device, said second leads also being electrically connected to said electrical component; and at least one mounting element attached to said connector body for mounting said connector to said external device, said at least one mounting element being flush with at least one of said side surfaces of said connector body, wherein said mounting elements of adjacent connectors can be received by one aperture located in said external device.

31. The connector of claim 30, wherein said external device is a printed circuit board.

32. The connector of claim 30, wherein said electrical component is a choke coil.

33. The connector of claim 30, wherein said mounting element is a split-end pin having a retainer.

34. The connector of claim 30, wherein said connector body is comprised of a first body element and a second body element, said first body element containing said cavity, and said second body element containing said electrical component.

35. The connector of claim 34, wherein said cavity includes a plurality of contour elements disposed therein, and at least one of said first electrical leads includes a bend which cooperates with at least one respective contour element in order to maintain said at least one electrical lead in contact with said modular plug.

36. A circuit board assembly comprising:

a microelectronic connector having;

a connector body comprising a first side and a second side, a cavity open to said first side, said cavity having an interior surface and configured to receive at least a portion of a modular plug, an aperture communicating with said cavity and said second side, and at least one contour element attached to said interior surface of said cavity;

a trailer communicating with said second side of said connector body, said trailer having, an electrical component, a plurality of first leads electrically connected to said electrical component, at least one of said plurality of first leads having a bend, said bend engaging said contour element within said cavity, said contour element retaining said first leads within said cavity and said trailer in substantial communication with said connector body, said contour element further cooperating with said bend to maintain said first leads in contact with said electrical leads of said modular plug, and a plurality of second leads electrically connected to said electrical component; and a circuit board having a plurality of electrical contacts, wherein said second leads are bonded to respective ones of said contacts so as to form an electrical connection between said second leads and said contacts.

37. A microelectronic connector assembly comprising:

a first means for housing connector components having;

a first and second exterior surface;

a cavity communicating with said first exterior surface, said cavity configured to receive at least a portion of a modular plug therein;

at least one means disposed within said cavity for aligning electrical leads;

an aperture communicating with said cavity and said second exterior surface; and second means for housing connector components, said means being mateable to said first means, said second means including at least one electrical lead having a bend, wherein at least a portion of said at least one electrical lead is inserted within said aperture and said cavity, said bend cooperating with said means for aligning electrical leads to maintain said at least one lead in contact with said modular plug.

* * * * *

UNITED STATES PATENT AND TRADEMARK OFFICE

CERTIFICATE OF CORRECTION

PATENT NO. : 6,116,963
DATED : September 12, 2000
INVENTOR(S) : Ronald A. Shutter It is certified that error appears in the above-identified patent and that said Letters Patent is hereby corrected as shown below:

Column 11,
Line 31, replace "lo said" with -- to said --.

Column 12,
Line 21, replace "having of" with -- having a --.

Signed and Sealed this

Fourth Day of December, 2001

*Attest:*

Nicholas P. Godici

NICHOLAS P. GODICI
*Acting Director of the United States Patent and Trademark Office*

*Attesting Officer*